United States Patent [19]

Puckett et al.

[11] Patent Number: 4,484,254

[45] Date of Patent: Nov. 20, 1984

[54] PAR FLOOD LAMP

[75] Inventors: Clarence D. Puckett; Arnold E. Westlund, Jr.; William G. Thiry, all of Winchester, Ky.

[73] Assignee: GTE Products Corporation, Stamford, Conn.

[21] Appl. No.: 380,496

[22] Filed: May 21, 1982

[51] Int. Cl.[3] ..... F21V 7/00

[52] U.S. Cl. ..... 362/309; 362/328; 362/329; 362/337; 362/338; 362/339; 362/340; 362/375

[58] Field of Search ..... 362/309, 328, 329, 337, 362/338, 339, 340, 375

[56] References Cited

U.S. PATENT DOCUMENTS 2,454,332 11/1948 Mitchell et al. ..... 362/337

3,340,393 9/1967 Franck et al. ..... 362/336

*Primary Examiner*—Stephen J. Lechert, Jr.

*Attorney, Agent, or Firm*—Lawrence R. Fraley

[57] ABSTRACT

A flood lamp having a lens with a series of concentrically disposed fluted rings on the internal lens surface in combination with an outer concentric ring adjacent to and wider than any one of the fluted rings and containing a plurality of semi-spherical protrusions disposed in an established pattern (e.g., circular or hexagonal). The flood lamp reflector has multiple reflective surfaces including a front section that is parabolic shape having a principle focal point, a spherical section having its center of radius coincident with the principle focal point of the parabolic front section, and a spherical rear section.

14 Claims, 9 Drawing Figures

PAR FLOOD LAMP

TECHNICAL FIELD

The present invention relates in general to an improved flood lamp, and in particular to an improved flood lamp of the PAR variety. Even more particularly, the invention is concerned with an improved flood lamp lens and reflector construction having, inter alia, an overall increased light output efficiency and improved beam candlepower. The available luminous flux from the lamp's source is utilized in a more efficient manner.

BACKGROUND

It is well known in the art to utilize PAR (parabolic aluminized reflector) lamps for general flood lighting applications. In particular, PAR 38 (those with a 4.75 inch face diameter) flood lamps have become exceptionally popular for short-to-medium-distance outdoor uses as well as indoors for display, decoration, accent, inspection, and downlightng applications. Examples of such flood lamps are manufactured and sold by the assignee of the instant invention under the product designations 75 PAR/FL, 150 PAR/FL, and 150 PAR/3FL. Typically, these lamps are of hardglass and include a medium skirt (screw-type) or side prong base at the rear thereof for connecting the lamp to the desired power source.

The beam produced by a PAR lamp is typically of substantially conical configuration and provides a substantially round pattern. This pattern changes to being oval or elliptical should the lamp be aimed at an acute angle with the light-receiving surface. With regard to flood lamps sold by the assignee of this invention, such lamps are typically classified into one of three categories: medium flood; wide flood; and very wide flood. Medium flood lamps are especially designed for shorter distance, general area floodlighting wherever lighting over wide spaces is desired with medium to high intensities. Wide flood lamps are designed to spread broad, uniform beams over wide areas where the number of fixtures and space is limited, while very wide flood lamps provide a beam spread almost twice as wide as conventional PAR flood lamps. These lamps may also possess a rated average life of from 2000 to 4000 hours (with many more recently introduced models greatly exceeding this), operate readily from standard household current (120 volt) and produce a beam having an output typically ranging from about 700 to about 3300 lumens.

Prior flood lamps, such as those of the type PAR 38 variety, include a lens that is either partially or substantially totally covered with small spherical protrusions which in turn may be used in combination with a stippled surface area (e.g., created by shot or sand blasting). The stippled surface usually appeared over substantially the center region of the lamp lens. The resultant light pattern from such a surface provides a generally undesired asymmetrical pattern. Also, the resultant pattern could be controlled to provide only minor variations therein depending on the stipple density and radii of the spherical protrusions.

In addition to the aforementioned drawbacks associated with the flood lamp lens, there are further problems associated with the flood lamp reflector. Prior flood lamps such as type PAR 38 flood lamps utilize a reflector having a multiple parabolic front (forward) section generated by the combination of three different radii portions, a middle section formed of a partial sphere and a heel or rear section that is also of a partial sphere. This prior art construction of a reflector, particularly when taken in combination with the described, faceted (spherical protrusions) lens, provides a relatively inefficient means of projecting the available light. This arrangement further provides a narrow latitude for beam pattern alteration and also an undesired, asymmetrical candlepower distribution.

DISCLOSURE OF THE INVENTION

It is an object of the present invention to provide a flood lamp having an improved reflector and lens construction for providing enhanced light output efficiency and an increased beam candlepower leading to a savings in lamp operating cost.

Another object of the present invention is to provide an improved flood lamp construction as in the foregoing object and which further provides improved control of the resulting beam pattern.

In accordance with the present invention, there is provided an improved flood lamp having enhanced light output efficiency and beam candlepower, along with improved control of beam pattern. The improvement in the operating parameters of the flood lamp is due to both improvements in lens and reflector construction. In accordance with one aspect of the invention there is provided a lens having a series of concentrically disposed fluted rings on the lens surface each having a progressively increased radius, along with an outer concentric ring portion adjacent to and wider than any one of the fluted rings. This outer concentric ring portion includes a plurality of semi-spherical protrusions within the lens surface. By combining fluted concentric rings having specified radii with small semi-spherical protrusions, a more controllable, symmetrical, and pleasing (softer) spot beam pattern is realized. The lamp's candlepower distribution may be readily varied to many different shapes by altering such factors as the number of fluted rings, the ring flute radii, and ring location with the protrusion elements. An increase in lumen efficiency is also realized due to increased light transmission in a more controllable geometric relation to the reflector's incident light.

BEST MODE FOR CARRYING OUT THE INVENTION

For a better understanding of the present invention together with other and further objects, advantages and capabilities thereof, reference is made to the following disclosure and appended claims in connection with the above described drawings.

Figure 1:
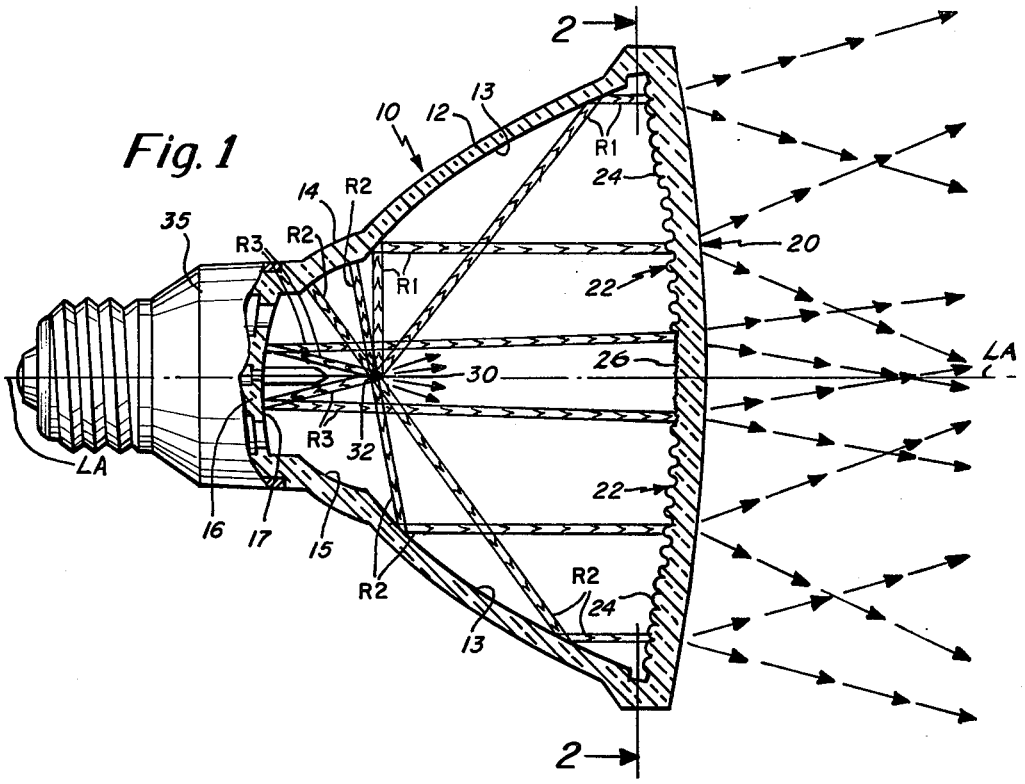
FIG. 1 is a cross-sectional, side elevation view of a flood lamp constructed in accordance with the principles of this invention.
Figure 2:
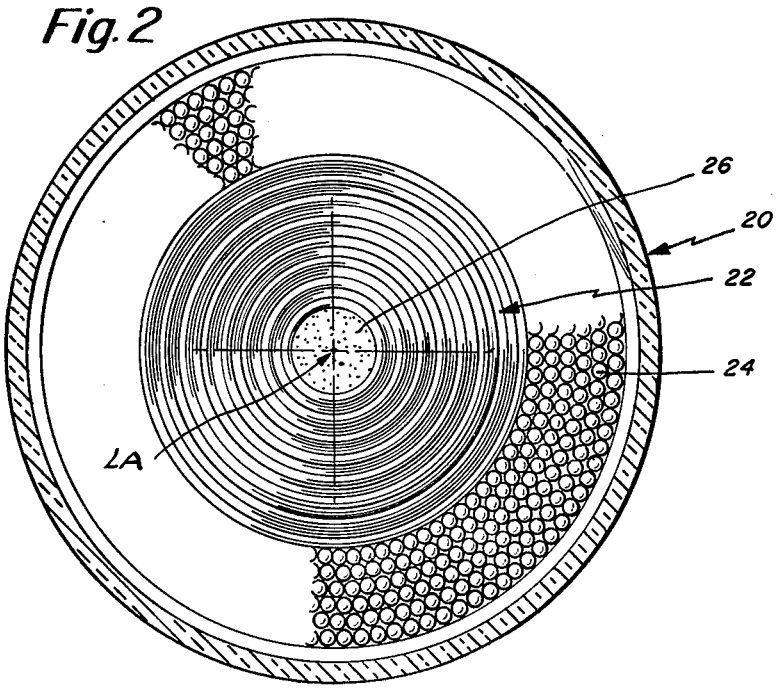
FIG. 2 is an elevational view of the first (internal) surface of the lens member of the invention as taken along the line 2—2 in FIG. 1.
Figure 3:
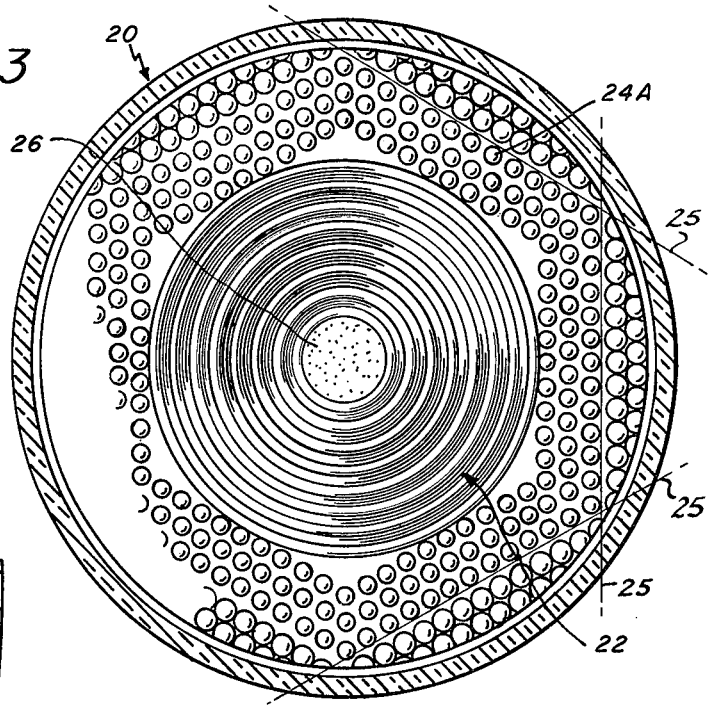
FIGS. 3 is an elevational view of a lens member in accordance with an alternate embodiment of the invention.

With regard to the drawings, and in particular FIGS. 1–3, there is shown a PAR-type flood lamp that generally comprises a reflector portion 10, a lens member 20, and a light source 30. The source 30 may be either a single incandescent (e.g., tungsten) filament or, alternatively, may be a pressurized halogen capsule. Light source 30 is disposed within and, therefore, substantially surrounded by reflector portion 10. In accordance with the invention, an optically improved reflector portion construction is combined with the curved flood lamp lens member 20 having both a concentric, fluted ring portion 22 and a concentric ring portion containing relatively small semi-spherical protrusions 24, whereby the combination provides a more accurate and uniform beam pattern. In addition to the reflector and lens, FIG. 1 also illustrates the metallic (e.g., aluminum) screw-in base 35 which is of conventional construction. Both the reflector and lens components of the invention are of hardglass material.

The reflector 10 illustrated in the drawings represents an improvement over previous PAR reflector designs by providing improved optical characteristics, yet without significantly changing the outer size or contour to any great extent so that the lamp remains compatible with any lamp fixtures presently used. Previously, the front (forward) section of the reflector (that adjacent the curved lens 20) was formed by a series of different diameter spherical segments. Furthermore, there was no interrelationship between the radii of the different segments of the front section and the radius of the middle section of the reflector.

As illustrated in the drawings, in accordance with the present invention, the reflector is provided with a first (front) section 12 which is now in the form of a true parabolic surface 13, thus producing a greater number of parallel rays when the light source 30 is located at the principle focus 32 of parabolic surface 13. FIG. 1 illustrates the rays R1 emanating from the source 30 and reflected at the parabolic surface 13 through the curved lens 20.

In addition to first, parabolic section 12, reflector 10 also comprises a second reflective section (14), said section being of substantially spherical configuration and contiguous to the first section. The radius of the spherical surface 15 of second section 14 is taken at the principle focus point 32 so that the center of the radius of this (second) section coincides with the principle focus point of parabolic surface 13. It is further noted that FIG. 1 illustrates the rays R2 emanating from source 30 and reflecting off surface 15. These rays then pass essentially back through the source 30 and are eventually reflected from the parabolic surface 13 of the first section.

Reflector 10 also includes a rear or heel (third) section 16 through which wiring extends in a conventional manner for providing electrical connection between base 35 and the light source 30. The rear section 16, contiguous to the described second section, has an inner, substantially spherical reflective surface 17 which may have a radius substantially the same as conventional prior lamps. In the instant invention, the radius of the third reflective surface is greater than that of the spherical second surface. In one embodiment, the parabolic front section 12 of the reflector may have a focal point of about 0.49 inch, and the radius of curvature of the middle, spherical section 14 may be about 0.86 inch. The radius of the rear section 16 in turn may be about 2.40 inch.

The inner reflective surfaces of reflector 10 may be constructed relatively smoothly throughout the different sections in which case the reflector remains "plane specular". Alternatively, this inner surface of the reflector throughout the different sections may be stippled by shot blasting various areas to provide a "diffuse specular" reflective surface.

As indicated previously, prior flood lamps utilized a lens that had a stippled external lens surface usually obtained by shot or sand blasting, in combination usually with a region containing several semi-spherical protrusions. The resultant light pattern from such a surface provided a generally asymmetrical pattern which was a function solely of the stippled density and semi-spherical protrusion pattern. However, in accordance with the present invention, there is now provided a combination of a reflector having at least three different reflective segments (sections) with an adjacent lens member of curved configuration having a first, inner surface comprised of fluted concentric rings 22 in combination with an outer concentric ring portion containing several relatively small semi-spherical protrusions, said outer ring portion adjacent to and generally wider than any one of the inner, fluted rings. As illustrated, for example in FIGS. 2 and 3, it is noted that the lens, when viewed in elevation, has a generally circular shape and is slightly cupped (see FIG. 1). In addition to the several concentric fluted rings 22 and semi-spherical protrusion concentric area 24, there is also provided a substantially circular central portion 26 which may be left plain (not fluted), but is preferably also stippled (FIGS. 2 and 3). In FIGS. 2 and 3, the area 26 is shown as having a very light density stipple. Furthermore, in the embodiment of FIGS. 2 and 3, there are employed a total of seven concentrically disposed fluted rings 22 on the first, inner surface of the lens. In other embodiments, different numbers of rings may be employed. The plurality of small semi-spherical protrusions, also referred to as facets, as illustrated in FIG. 2 are disposed along a circular band between the outermost ring 22 and the periphery of the lens surface. FIG. 3 illustrates a series of protrusions 24A which are arranged somewhat differently, more in a hexagonal manner at least insofar as the inner course of protrusions is concerned. FIG. 3 also illustrates a demarcation line 25 (actually several are shown, depending on the pattern of protrusions employed). From this line inwardly, each of the facets are formed with an outer diameter of 0.142 by 0.109 radius. Outwardly of this line, the facets are recut to approximately 0.156–0.162 outer diameter with a 0.109 radius.

With the use of a combination of fluted concentric rings and small semi-spherical protrusions within an outer ring portion, there has been provided a more controllable, symmetrical, and pleasing (softer) flood beam pattern. Furthermore, the candlepower distribution of the lamp (maximum center beam and/or spread) may be varied to many desired shapes (such as medium, wide, and very wide flood) by altering such factors as the number of rings, the ring flute radii, and ring location with the small semi-spherical protrusions as well as the density (of the central area). An increase in lumen efficiency is also realized by using fluted rings which provide a better transmission control having a definite geometric relation to the reflector's incident light.

In one example, the lens employed seven concentric rings on the inner surface of the lens with the outer ring portion having the pattern of protrusions shown in FIG. 2. This particular combination provides a beam pattern that has a relatively narrow flood spread. In another seven ring embodiment, semi-spherical protrusions having different depth and radius dimensions were employed. The result was a medium flood spread. In all of the aforementioned examples of various fluted ring and semi-spherical protrusion combinations, it is understood that these lens components are located on the internal (first) surface of the curved (non-linear) lens member 20. The outer, or second, surface of the lens understandably runs parallel to the first surface and is smooth. A smooth outer surface is highly desirable in that it eliminates dust, dirt, etc. build-up as typically occurs in PAR flood lamps having lens elements in the outer surface. Accordingly, the lens elements of the instant invention face the light source and thereby perform their refractive functions prior to the altered light beams passing through the remaining thickness of the glass lens.

As also shown in FIGS. 1 and 2, lens member 20 is oriented such that the lamp axis LA—LA passes through the center thereof. This axis also passes through the midpoint of non-fluted, central portion 26. Regarding FIGS. 2 and 3, this arrangement is such that the fluted rings are concentrically disposed about central portion 26 (and, therefore, axis LA—LA) each at an increasing radius (the outermost, contiguous to portion 24 having the several protrusions, being at the greater radius while the innermost, contiguous to the central portion 26, is at the smallest radius). Central portion 26, as shown, is of circular configuration.

Figure 4A:
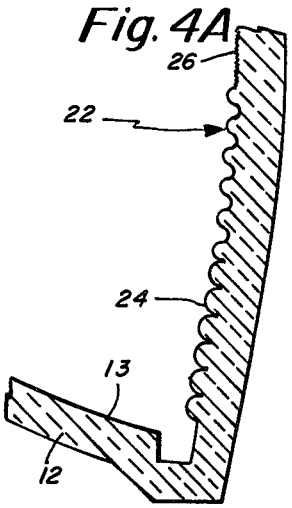
FIGS. 4A, 4B, and 4C are fragmentary cross-sectional views showing different specific forms of the concentric fluted rings and semi-spherical protrusions.
Figure 4B:
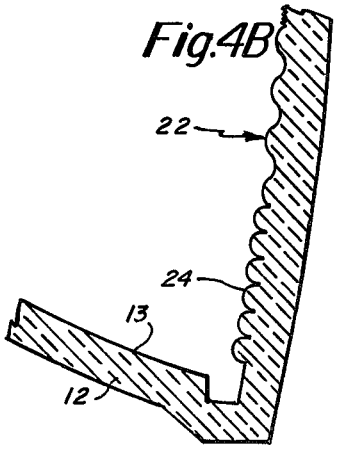
Figure 4C:
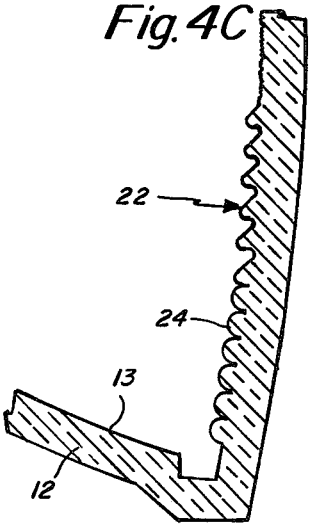
Figure 5A:
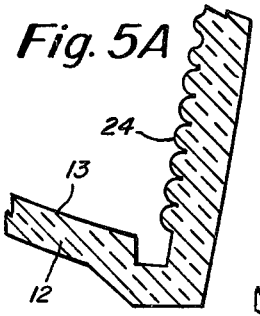
FIGS. 5A and 5B are fragmentary cross-sectional views showing different specific forms for the semi-spherical protrusions used in the invention's lens member.
Figure 5B:
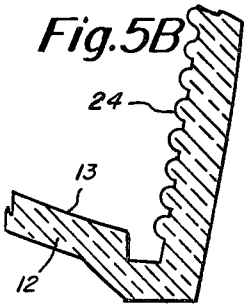

FIGS. 4A, 4B, and 4C illustrate fragmentary sections through the fluted ring portion as well as the outer, concentric portion 24 having the described semi-spherical protrusions therein of lens 20, illustrating fluted ring and semi-spherical protrusion patterns which provide varying amount of spread for the resulting beam. FIG. 4A shows a flute and protrusion pattern capable of providing wide spread, while FIG. 4B shows a narrow spread pattern. FIG. 4C shows a special fluted ring portion where each of the flutes 22 are slightly skewed in comparison to the other fluted rings shown herein. Similarly, FIGS. 5A and 5B show fragmentary sections through the protrusions. FIG. 5A illustrates a wide spread while FIG. 5B illustrates a narrow spread.

Figure 6:
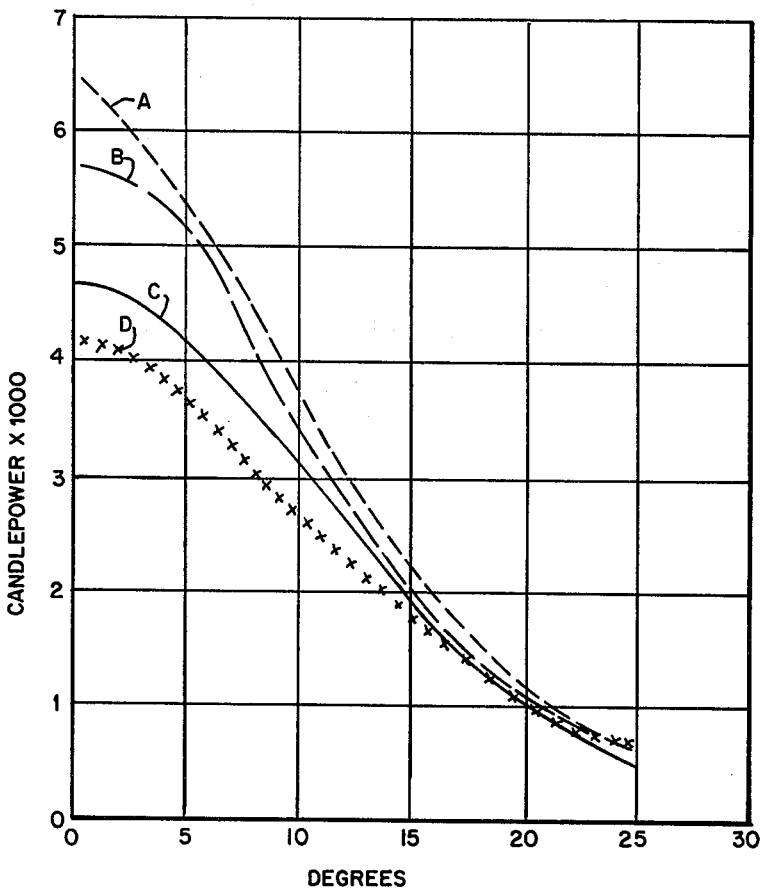
FIG. 6 is a graph of candlepower versus degrees (from lamp axis) showing a series of candlepower distribution curves for different ring and semi-spherical protrusion combinations.

FIG. 6 is a graph of candlepower versus degrees (from lamp axis) for a limited number of lamps constructed in accordance with the principles of the invention, which clearly indicates the feature of the invention having to do with the control over resulting beam pattern by use of various combinations of rings and sphericl protrusions. Curve A represents an embodiment employing eight concentric rings with the protrusions in the outer band having a radius of 0.109 inch and formed in a hexagonal pattern. Curve B illustrates an embodiment in which there are six concentric rings, and the semi-spherical protrusions are arranged in a circular pattern (FIG. 2) and formed with two different radii. Curve C illustrates another embodiment in which there are provided seven rings in combination with protrusions having a radius of 0.109 inch but disposed in a tight hexagonal pattern similar to that shown in FIG. 3. A tighter pattern is illustrated in FIG. 5A. Finally, FIG. 6 illustrates by means of the curve D a prior art candlepower distribution curve such as one in which the lamp has on its lens surface only semi-spherical protrusions extending partially or totally over the lamp lens surface. The invention thus clearly provides enhanced output results in comparison to this prior art embodiment.

While there have been shown and described what are at present considered the preferred embodiments of the invention, it will be obvious to those skilled in the art that various changes and modifications may be made therein without departing from the scope of the invention as defined by the appended claims.

We claim:

1. In a flood lamp including a reflector portion, a lens member adjacent said reflector portion, and a light source disposed within said reflector portion and substantially surrounded thereby, the improvement wherein said lens member comprises:

a substantially curved member having a first, internal surface including a series of concentrically disposed fluted rings formed therein and an outer concentric ring portion having a plurality of relatively small semi-spherical protrusions formed therein, each of said fluted rings being disposed at a progressively increasing radius from the axis of said spot lamp passing through said curved member, said outer concentric ring portion contiguous to the outermost of said fluted rings and of a width greater than any one of said fluted rings.

2. The flood lamp according to claim 1 wherein said first surface of said curved member is located facing said light source within said reflector portion.

3. The flood lamp according to claim 2 wherein said curved member further includes an outer, second surface substantially parallel to said first surface, said second surface being substantially smooth.

4. The flood lamp according to claim 1 wherein said reflector portion includes at least three reflective sections, a first of said sections being substantially of parabolic configuration and located adjacent said lens member, a second of said reflective sections being of substantially spherical configuration and located contiguous said first section, and a third of said reflective sections being of substantially spherical configuration and located contiguous said second section.

5. The flood lamp according to claim 4 wherein said substantially parabolic first reflective section includes a principle focal point, said substantially spherical second reflective section having its center of radius coincident with said principle focal point.

6. The flood lamp according to claim 5 wherein the radius of said substantially spherical third reflective segment is greater than the radius of said substantially spherical second reflective segment.

7. The flood lamp according to claim 1 wherein said first surface of said curved member includes a substantially central, non-fluted portion, said central portion having said lamp axis passing therethrough.

8. The flood lamp according to claim 7 wherein said central portion is substantially circular and is located contiguous the innermost of said fluted rings, said central portion being of stippled configuration.

9. The flood lamp according to claim 7 wherein said central portion of said first surface comprises about five percent of the total area of said first surface, said concentrically disposed fluted rings comprises about thirty-three percent of said total first surface area, and said concentric ring portion having said semi-spherical protrusions comprises about sixty-two percent of said total first surface area.

10. The flood lamp according to claim 1 wherein each of said rings of said concentrically disposed fluted rings is of skewed configuration.

11. The flood lamp according to claim 1 wherein said semi-spherical protrusions formed within said ring portion are disposed in a substantially circular pattern.

12. The flood lamp according to claim 1 wherein said semi-spherical protrusions formed within said ring portion are disposed in a substantially hexagonal pattern.

13. The flood lamp according to claim 1 wherein each of said semi-spherical protrusions is of a wide or narrow spread.

14. The flood lamp according to claim 1 wherein each of said fluted rings is of a wide or narrow spread.

* * * * *